US009405233B2

(12) United States Patent
Nakamura et al.

(10) Patent No.: US 9,405,233 B2
(45) Date of Patent: Aug. 2, 2016

(54) SLIDING MEMBER WITH A BASE MATERIAL FOR CONTACTING A MEMBER TO BE SLID, PROCESS CARTRIDGE HAVING THE SLIDING MEMBER, AND IMAGE FORMING APPARATUS HAVING THE SLIDING MEMBER

(71) Applicant: FUJI XEROX CO., LTD., Tokyo (JP)

(72) Inventors: Yu Nakamura, Kanagawa (JP); Daisuke Tano, Kanagawa (JP); Masato Ono, Kanagawa (JP); Daisuke Tanaka, Kanagawa (JP); Masayuki Seko, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/722,790

(22) Filed: May 27, 2015

(65) Prior Publication Data

US 2016/0187814 A1 Jun. 30, 2016

(30) Foreign Application Priority Data

Dec. 26, 2014 (JP) ..... 2014-266095

(51) Int. Cl.
*G03G 21/00* (2006.01)
*G03G 15/16* (2006.01)

(52) U.S. Cl.
CPC ..... *G03G 15/161* (2013.01)

(58) Field of Classification Search
CPC ..... G03G 21/0017; G03G 21/0011; G03G 21/0005; G03G 15/161
USPC ..... 399/350, 343
See application file for complete search history.

(56) References Cited

U.S. PATENT DOCUMENTS

| | | | | |
|---|---|---|---|---|
| 5,689,783 | A * | 11/1997 | Sasame | G03G 15/0812 399/274 |
| 2006/0216084 | A1 | 9/2006 | Kojima et al. | |
| 2007/0140762 | A1 * | 6/2007 | Ueno | G03G 21/0017 399/350 |
| 2010/0166472 | A1 * | 7/2010 | Kato | G03G 21/0017 399/350 |
| 2011/0135361 | A1 * | 6/2011 | Kabata | G03G 21/0017 399/350 |

FOREIGN PATENT DOCUMENTS

| | | | |
|---|---|---|---|
| JP | 2006-276843 | A | 10/2006 |
| JP | 2013-076970 | A | 4/2013 |

* cited by examiner

*Primary Examiner* — Billy Lactaoen
(74) *Attorney, Agent, or Firm* — Oliff PLC

(57) ABSTRACT

A sliding member includes a base material including a contact area which contacts with a member to be slid, wherein a Young's modulus E1 with respect to the thickness of the contact area from a surface of the contact area is from 10 MPa to 200,000 MPa and a thickness T of the contact area is from 10 nm to 500 nm.

10 Claims, 5 Drawing Sheets

SLIDING MEMBER WITH A BASE MATERIAL FOR CONTACTING A MEMBER TO BE SLID, PROCESS CARTRIDGE HAVING THE SLIDING MEMBER, AND IMAGE FORMING APPARATUS HAVING THE SLIDING MEMBER

CROSS-REFERENCE TO RELATED APPLICATIONS

This application is based on and claims priority under 35 USC 119 from Japanese Patent Application No. 2014-266095 filed Dec. 26, 2014.

BACKGROUND

1. Technical Field

The present invention relates to a sliding member, a process cartridge, and an image forming apparatus.

2. Related Art

In an electrophotographic image forming apparatus, a sliding member that slides on a member to be slid is provided. As the sliding member, a cleaning member for cleaning a toner remaining on an image holding member or intermediate transfer belt, which is a member to be slid, or the like may be exemplified.

As the cleaning member, a plate-like member called a cleaning blade is used. The cleaning blade is provided such that the corner portion of the cleaning blade contacts with the member to be slid and a developer remaining on the member to be slid is scraped off by the corner portion by sliding on the member to be slid.

SUMMARY

According to an aspect of the invention, there is provided a sliding member including:

a base material including a contact area which contacts with a member to be slid, wherein a Young's modulus E1 with respect to the thickness of the contact area from a surface of the contact area is from 10 MPa to 200,000 MPa, and a thickness T of the contact area is from 10 nm to 500 nm.

BRIEF DESCRIPTION OF THE DRAWINGS

Exemplary embodiments of the present invention will be described in detail based on the following figures, wherein.

DETAILED DESCRIPTION

Figure 1:
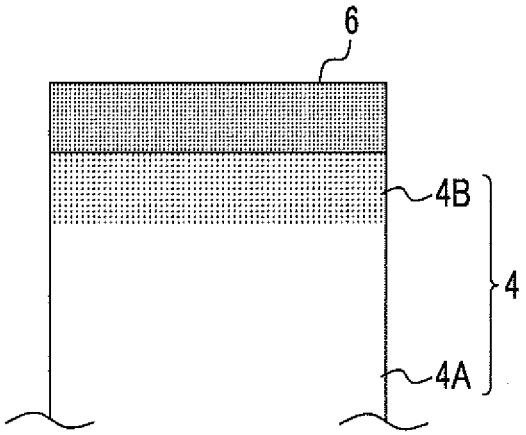
FIG. 1 is a schematic cross-sectional view showing an example of a sliding member according to an exemplary embodiment.

Hereinafter, exemplary embodiments of a sliding member, a cleaning device, an image forming apparatus, and a process cartridge of the present invention will be described in detail.

<Sliding Member>

A sliding member according to an exemplary embodiment (hereinafter, simply referred to as a "sliding member") is a sliding member that contacts with and slides on a member to be slid provided in various apparatuses or the like.

The sliding member according to the exemplary embodiment has a base material including a contact area which contacts with the member to be slid, a Young's modulus E1 with respect to the thickness of the contact area from the surface of the contact area is from 10 MPa to 200,000 MPa, and the thickness T of the contact area is from 10 nm to 500 nm.

Here, as a representative example of the sliding member, a cleaning blade for removing and cleaning a toner remaining on the surface of an image holding member or an intermediate, transfer medium, which is a member to be slid, in an electrophotographic image forming apparatus may be exemplified.

In recent years, it has been desired to form a fine image and a toner having a small particle size is used in an image forming apparatus. As a cleaning blade of the image forming apparatus using the toner having a small particle size, a cleaning blade that may satisfactorily remove fine residual toner, have excellent durability itself, and maintain the removal state of the residual toner for a long period of time is required.

Regarding a reduction of the occurrence of chips in the contact area, a method of further preventing the occurrence of chips has been desired. In addition, the reduction of the occurrence of chips in the contact area is also desired for sliding members other than the cleaning blade.

Here, the sliding member according to the exemplary embodiment includes a contact area which contacts with the member to be slid in a part of the base material, and the Young's modulus E1 with respect to the thickness of the contact area from the surface of the contact area is from 10 MPa to 200,000 MPa and the thickness T of the contact area is from 10 nm to 500 nm.

Since the sliding member according to the exemplary embodiment has such a configuration, the occurrence of chips in the contact area may be prevented.

It is assumed that the above effect is obtained because the sliding member has the following actions.

First, the sliding member according to the exemplary embodiment has a contact area having such a high hardness that the Young's modulus E1 is within the above range and such a thin thickness that the thickness T falls within the above range. When this contact area has the Young's modulus E1 and high hardness, even in a case in which the sliding member slides on the member to be slid, chips hardly occur in the contact area.

In addition, when the high hardness contact area is thin and is present as a part of the base material, even in the case in which the sliding member slides on the member to be slid, the contact area is hardly flaked off and also the flexibility that the base material itself has is not easily deteriorated by the contact area. As a result, for example, even when local stress concentration occurs in the contact area due to contact with a foreign substance (for example, a magnetic particle or end portion of recording medium) while the sliding member slides on the member to be slid, it may be considered that the stress is alleviated and the occurrence of chips in the contact area may be prevented.

Accordingly, the sliding member according to the exemplary embodiment may prevent the occurrence of chips in, the contact area.

Further, if the sliding member according to the exemplary, embodiment is used as a cleaning member (cleaning blade), the occurrence of chips in the contact area is prevented even in the case in which the sliding member slides on the member to be slid. Thus, cleaning failure caused by the chips is also prevented.

Hereinafter, the configuration of the sliding member according to the exemplary embodiment will be described in detail.

The sliding member according to the exemplary embodiment will be described with reference to FIG. 1. Here, FIG. 1 is a schematic cross-sectional view of a main part showing an example of a sliding member according to an exemplary embodiment.

As shown in FIG. 1, for example, the sliding member according to the exemplary embodiment includes a base material 4 having a carbon containing area 4B, and a carbon layer 6 provided on the surface of the carbon containing area 4B at the side which is in contact with the member to be slid. Here, the carbon containing area 4B is formed as a part of the base material 4, and the carbon containing area 4B and the carbon layer 6 form the contact area which contacts the member to be slid.

Then, the Young's modulus E1 of the contact area formed, of the carbon containing area 4B and the carbon layer 6 is from 10 MPa to 200,000 MPa and the thickness T of the contact area is from 10 nm to 500 nm.

Here, the reference number 4A in FIG. 1 refers to a base member which excludes the carbon containing area 4B.

It is possible for the sliding member according to the exemplary embodiment not to have the carbon layer 6 shown in FIG. 1 and in this case, the carbon containing area 4B forms the contact area which contacts with the member to be slid.

In this case, the Young's modulus E1 of the contact area formed of the carbon containing area 4B is from 10 MPa to 200,000 MPa, and the thickness T of the contact area is from 10 nm to 500 nm.

In addition, as for the sliding member according to the exemplary embodiment, a Young's modulus E2 of the base material at a site where a distance from the surface of the contact area exceeds the thickness of the contact area is from 1 MPa to 500 MPa, and the Young's modulus E1 and the Young's modulus E2 satisfy a relationship of $E2<E1$. Here, the Young's modulus E2 refers to a Young's modulus of the base material which does not correspond to the contact area.

When the Young's modulus E2 of the base material which does not correspond to the contact area is within the above range and the relationship with the Young's modulus E1 is satisfied, the sliding member is bent during sliding with the member to be slid and thus the occurrence of chips in the contact area is easily prevented.

Here, the Young's modulus E1 with respect to the thickness of the surface of the contact area (sometimes referred to as "the thickness of the contact area") and the Young's modulus E2 of the base material at a portion exceeding the surface of the contact area is measured in the following manner.

The Young's moduli E1 and E2 according to the exemplary embodiment are measured using a Nanoindentation method. Specifically, an indentation depth-load curve is measured using a PICODENTOR HM500, manufactured by Fischer Instruments K.K. and a Berkovich-type diamond indenter, a load is applied at a maximum indentation depth of 1000 nm, subsequently the load is removed, and the inclination of an unloading curve is obtained as a Young's modulus.

Here, at the boundary position between the contact area and the base material which does not correspond to the contact area, an inflection point appears on the unloading curve and thus the thickness of the contact area is approximately the same as the inflection point of the unloading curve. Therefore, the Young's modulus E1 corresponds to the inclination of the unloading curve on the side of the shallower indentation depth than the inflection point and the Young's modulus E2 corresponds to the inclination of the unloading curve on the side of the deeper indentation depth than the inflection point.

In the exemplary embodiment, the thickness T of the contact area refers to the thickness of the carbon containing area when the contact area is formed of only the carbon containing area, and refers to a total thickness of the carbon containing area and the carbon layer when the contact area is formed of the carbon containing area and the carbon layer.

Due to the fact that the physical properties of the contact area and the base material excluding the contact area are different from each other, the phases observed by an atomic force microscope (AFM) are different and thus the boundary therebetween is apparent. Therefore, the thickness T of the contact area is measured as follows.

That is, using the atomic force microscopes (AFM) S-image and Nanonavi 2, manufactured by Hitachi High-Technologies Corporation, a shape (uneven) image and a phase image of the cross section of the sliding member are measured and the thickness T is obtained from the images.

The sliding member according to the exemplary embodiment is a sliding member which is in contact with and slides on the member to be slid provided in an image forming apparatus.

Here, an aspect in which the sliding member is applied as a cleaning blade for an image holding member which is the member to be slid will be described with reference to FIG. 2. Here, FIG. 2 is a schematic cross-sectional view showing an example of a cleaning blade to which the sliding member according to the exemplary embodiment is applied.

Figure 2:
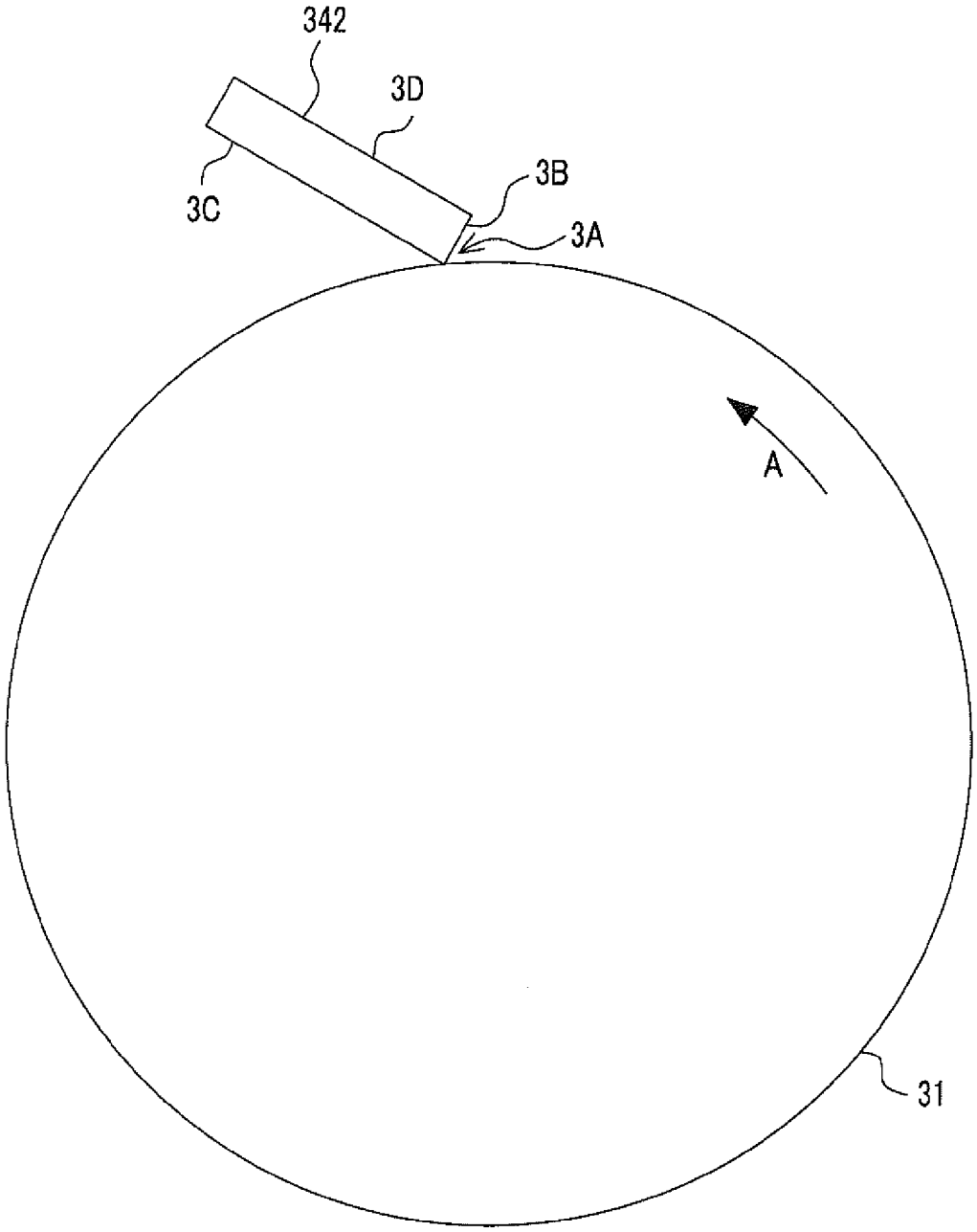
FIG. 2 is a schematic view showing an example of a cleaning blade to which the sliding member according to the exemplary embodiment is applied.

As shown in FIG. 2, the cleaning blade (the sliding member according to the exemplary embodiment) has a contact corner portion (contact area) 3A which is in contact with a rotationally driven image holding member (photoreceptor drum) 31 and cleans the surface of the image holding member 31, a tip end surface 3B which is one of surfaces forming the contact corner portion 3A and faces an upstream side in the rotationally driving direction (in the direction of arrow A), a front surface 30 which is one of sides forming the contact corner portion 3A and faces a downstream side in the driving direction (in the direction of arrow A), and a rear surface 3D which is opposite to the front surface 3C.

For convenience, in FIG. 2, the direction in which the image holding member (photoreceptor drum) 31 is rotationally driven is indicated with the arrow A. However, FIG. 2 shows a state in which the image holding member 31 is stopped.

Figure 3:
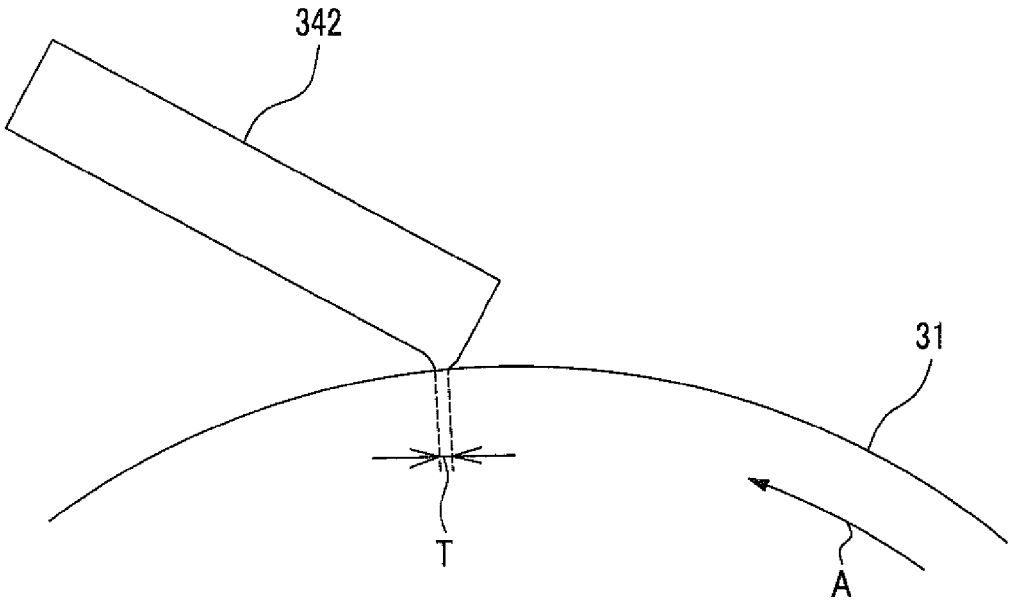
FIG. 3 is a schematic view showing a state in which the cleaning blade to which the sliding member according to the exemplary embodiment is applied is in contact with an image holding member being driven.

The sliding member according to the exemplary embodiment is disposed to be in contact with the surface of the image holding member 31 as shown in FIG. 2. Therefore, when the image holding member 31 is rotationally driven, as shown in FIG. 3, sliding occurs in the contact corner portion 3A between a cleaning blade 342 and the image holding member 31 to form a nip portion T. The surface of the image holding member 31 is slid to remove (clean) the toner remaining on the surface of, the image holding member 31 or the like.

Base Material

Resin

It is preferable that the base material for the sliding member according to the exemplary embodiment contains a resin over the whole area. That is, in the contact area, an area provided in the base material (for example, a carbon containing area which will be described later) also contains a resin.

As the resin contained in the base material, rubber is preferable. Specific examples thereof include polyurethane rubber, silicon rubber, fluororubber, chloroprene rubber, butadiene rubber, and the like.

Among these, from the viewpoint of excellent abrasion resistance, polyurethane rubber is preferable and highly crystallized polyurethane rubber is particularly preferable.

Polyurethane rubber is synthesized by polymerizing polyisocyanate and polyol. In addition, a resin having a functional group which may react with an isocyanate group other than polyol may be used. Polyurethane rubber preferably has hard segments and soft segments.

Here, the "hard segments" and "soft segments" mean segments in which in a polyurethane rubber material, a material constituting the former is relatively harder than a material constituting the latter, and the material constituting the latter is relatively softer than the material constituting the former.

Further, the above "polyisocyanate" does not form a crosslinking structure in a resin to be synthesized and thus the base material does not have a crosslinking structure by isocyanate.

The combination of the material (hard segment material) constituting the hard segments and the material (soft segment material) constituting the soft segments is not particularly limited, and the materials may be selected from known resin materials so that one material is relatively harder than the other material, and the other material is relatively softer than the one material. However, in the exemplary embodiment, the following combination is preferable.

Soft Segment Material

Examples of polyols as the soft segment material include polyester polyols which are obtained by dehydration condensation of dials and dibasic acids, polycarbonate polyols which are obtained by the reaction of dials and alkyl carbonates, polycaprolactone polyols, polyether polyols, and the like.

Examples of commercially available products of the polyols which are used as the soft segment material include PLACCEL 205, and PLACCEL 240, manufactured by Daicel Corporation., Teslac 2464, manufactured by Hitachi Chemical Co., Ltd, and the like.

Hard Segment Material

As the hard segment material, a resin having a functional group which may react with an isocyanate group is preferably used. In addition, the hard segment material is preferably a flexible resin, and more preferably an aliphatic resin having a straight chain structure from the viewpoint of flexibility.

Specific example thereof include an acrylic resin including two or more hydroxyl groups, a polybutadiene resin including two or more hydroxyl groups, and an epoxy resin having two or more epoxy groups.

Examples of commercially available products of the acrylic resin including two or more hydroxyl groups include Actflow (registered trademark) (grade: UMB-2005B, UMB-2005P, UMB-2005, UME-2005, and the like) manufactured by Soken Chemical Engineering Co., Ltd., and the like.

Examples of commercially available products of the polybutadiene resin including two or more hydroxyl groups include R-45HT manufactured by Idemitsu Kosan Co., Ltd., and the like.

The epoxy resin having two or more epoxy groups is preferably not a general epoxy resin of the related art being hard and fragile, but an epoxy resin being more flexible and tougher than epoxy resins of the related art.

For example, as for the molecular structure, the epoxy resin preferably has; in a main chain structure thereof, structure (flexible skeleton) which may increase mobility of a main chain. Examples of the flexible skeleton include an alkylene skeleton, a cycloalkane skeleton, a polyoxyalkylene skeleton, and the like, and particularly, a polyoxyalkylene skeleton is preferable.

In addition, as for the physical properties, the epoxy resin having a lower viscosity with respect to the molecular weight than epoxy resins in the related art is preferable. Specifically, the weight average molecular weight is in the range of 900±100, and the viscosity at 25° C. is preferably in the range of 15000 mPa·s±5000 mPa·s, and more preferably in the range of 15000 mPa·s±3000 mPa·s. Examples of commercially available products of the epoxy resin having this characteristic include EPLICON EXA-4850-150 manufactured by DIC Corporation, and the like.

When the hard segment material and the soft segment material are used, the weight ratio (hereinafter, referred to as "hard segment material ratio") of the material constituting the hard segments with respect to the total amount of the hard segment material and the soft segment material is preferably in a range of from 10% by weight to 30% by weight, more preferably in a range of from 13% by weight to 23% by weight, and even more preferably in a range of from 15% by weight to 20% by weight.

When the hard segment material ratio is 10% by weight or more, an abrasion resistance is easily obtained. When the hard segment material ratio is 30% by weight or less, the material is not too hard, thus flexibility and extensibility are improved, and the occurrence of chips is easily prevented.

Polyisocyanate

Examples of polyisocyanate which is used in synthesis of polyurethane rubber include 4,4'-diphenylmethane diisocyanate (MDI), 2,6-toluene diisocyanate (TDI), 1,6-hexane diisocyanate (HDI), 1,5-naphthalene diisocyanate (NDI), 3,3-dimethylphenyl-4,4-diisocyanate (TODI), and the like.

From the viewpoint of easiness of the formation of hard segment aggregates having a desired size (particle size), 4,4'-diphenylmethane diisocyanate (MDI), 1,5-naphthalene diisocyanate (NDI), hexanemethylene diisocyanate (HDI) are preferable as polyisocyanate.

The blending amount of polyisocyanate with respect to 100 parts by weight of a resin having a functional group which may react with an isocyanate group is preferably from 20 parts by weight to 40 parts by weight, more preferably from 20 parts by weight to 35 parts by weight, and even more preferably from 20 parts by weight to 30 parts by weight.

When the blending amount is 20 parts by weight or more, a large amount of urethane bonding is obtained to thereby enable the growth of hard segments, and a desired hardness is easily obtained. When the blending amount is 40 parts by weight or less, the size of hard segments does not excessively increase, the extensibility is obtained, and the occurrence of chips in the sliding member is easily prevented.

Chain Extender and Crosslinking Agent

Examples of a chain extender and a crosslinking agent include diols (bifunctional), triols (trifunctional), tetraols (tetrafunctional), and the like. These may be used in combination.

In addition, amine compounds may be used as the chain extender and the crosslinking agent.

As the chain extender, diols and diamines are preferable and specific examples thereof include 1,4-butanediol, and ethylene glycol.

As the crosslinking agent, a tri- or higher functional crosslinking agent is preferable and specific examples thereof include trimethylolpropane, glycerin, triisopropanolamine and the like.

The blending amount of the crosslinking agent with respect to 100 parts by weight of a resin having a functional group which may react with an isocyanate group is preferably equal to or less than 2 parts by weight. Since the blending amount is equal to or less than 2 parts by weight, molecular motion is not restrained due to chemical crosslink, hard segment derived from urethane bonding due to aging is largely grown, and the required hardness is easily obtained.

The weight average molecular weight of the polyurethane rubber contained in the base material is preferably in a range of from 1000 to 4000 and more preferably in a range of from 1500 to 3500.

Method of Producing Base Material

First, the base material according to the exemplary embodiment may be obtained by preparing a base material containing a resin over the whole of the base material, and forming a contact area on the prepared base material.

The production method will be described in detail.

Method of Forming Base Material (Base Material Before Contact Area is Formed)

First, as the base material according to the exemplary embodiment, a base material containing a resin over the whole area is prepared.

Here, the method of preparing the base material using polyurethane rubber as the resin will be described.

For the preparation of the base material using polyurethane rubber, a general method of producing polyurethane such as a prepolymer method or a one-shot method is used.

Since polyurethane with excellent strength and abrasion resistance is obtained, the prepolymer method is suitable for the exemplary embodiment. However, the production method is not limited.

The base material using polyurethane rubber is prepared in the following manner. Polyisocyanate, a crosslinking agent, and the like are mixed with the above-described polyols to prepare a base material forming composition. This base material forming composition is formed into a sheet shape using, for example, centrifugal molding or extrusion molding, and by performing a cut process and the like, a base material is prepared.

Here, as one example, a method of producing the base material before a contact area is formed using polyurethane rubber will be described in detail.

First, the soft segment material (for example, polycaprolactone polyol) and the hard segment material (for example, acrylic resin including two or more hydroxyl groups) are mixed (for example, a weight ratio of 8:2).

Next, polyisocyanate (for example, 4,4'-diphenyl methane diisocyanate) is added to the mixture of the soft segment material and the hard segment material, and the mixture is allowed to react under a nitrogen atmosphere, for example. At that time, the temperature is preferably from 60° C. to 150° C., and more preferably from 80° C. to 130° C. In addition, the reaction time is preferably from 0.1 hour to 3 hours, and more preferably from 1 hour to 2 hours.

Next, the polyisocyanate compound is further added to the mixture, and the mixture is allowed to react under a nitrogen atmosphere, for example, to obtain a prepolymer. At that time, the temperature is preferably from 40° C. to 100° C., and more preferably from 60° C. to 90° C. In addition, the reaction time is preferably from 30 minutes to 6 hours, and more preferably from 1 hour to 4 hours.

Next, the temperature of the prepolymer is increased and subjected to defoaming under the reduced pressure. At that time, the temperature is preferably from 60° C. to 120° C., and more preferably from 80° C. to 100° C. In addition, the reaction time is preferably from 10 minutes to 2 hours, and more preferably from 30 minutes to 1 hour.

After that, a chain extender (for example, 1,4-butanediol) and a crosslinking agent (for example, trimethylolpropane) are added and as necessary, a thixotropy composition is mixed to the prepolymer. Thus, a base material forming composition is prepared.

Next, the base material forming composition is poured into a mold of a centrifugal molding machine and subjected to a hardening reaction. At this time, the temperature of the mold is preferably from 80° C. to 160° C., and more preferably from 100° C. to 140° C. In addition, the reaction time is preferably from 20 minutes to 3 hours, and more preferably from 30 minutes to 2 hours.

The hardened composition is then subjected to a crosslinking reaction and cooled. In this crosslinking reaction, the temperature of aging heating is preferably from 70° C. to 130° C., more preferably from 80° C. to 130° C., and even still more preferably from 100° C. to 120° C. In addition, the reaction time is preferably from 1 hour to 48 hours, and more preferably from 10 hours to 24 hours.

After cooling, the composition is cut into a desired shape to obtain a base material before a contact area is formed.

As for the base material before a contact area is formed, it is preferable that the base material is not subjected to a hardening treatment by isocyanate.

When the contact area is not subjected to a hardening treatment by isocyanate, the flexibility is high and thus, while sliding on the member to be slid, even when local stress concentration occurs in the contact area due to the contact with a foreign substance (for example, magnetic particle or a recording medium end), it is considered that the stress is easily alleviated and the occurrence of chips is more easily prevented.

The "polyisocyanate" used when the above-described polyurethane rubber is obtained does not form a crosslinking structure in a synthesized resin and the does not form the "crosslinking structure by isocyanate".

With respect to the sliding member according to the exemplary embodiment, the Young's modulus of the base material before the contact area is formed corresponds to the above-described Young's modulus E2 and is preferably from 1 MPa to 500 MPa, more preferably from 5 MPa to 100 MPa, and even more preferably from 8 MPa to 50 MPa.

Such a Young's modulus may be controlled by, for example, adjusting the weight ratio of the hard segment material and the soft segment material, the amount of the crosslinking agent, the amount of the catalyst, and the like, in the case where the base material is formed by using polyurethane rubber.

Contact Area Included in Base Material

A part of the base material according to the exemplary embodiment includes a contact area which contacts with the member to be slid.

This contact area has a Young's modulus E1 of from 10 MPa to 200,000 MPa on the surface and a thickness T of 10 nm to 500 nm.

When the Young's modulus E1 is too low, the base material is easily deformed and when the Young's modulus is too high, there is a concern of the member to be slid being damaged. The Young's modulus E1 is preferably from 20 MPa to 130,000 MPa and more preferably from 30 MPa to 9,000 MPa.

In addition, the thickness T is preferably from 100 nm to 400 nm and more preferably from 150 nm to 300 nm from the viewpoint of easily obtaining Young's modulus suitable for sliding.

Such a contact area may have any composition. However, from the viewpoint of preventing flaking between the contact area and base material excluding the contact area, it is preferable that the contact area is formed by including a carbon containing area.

In order to achieve the above Young's modulus E1, if the carbon containing area includes carbon having sp3 bonding and the resin contained in the base material, a high hardness and thin contact area is easily formed. A method of forming such a carbon containing area is not particularly limited and examples thereof include a method in which plasma ions are directly implanted into the base material including resin and thus carbon atoms having sp3 bonding are infiltrated into the base material.

The above-described high hardness and thin contact area is not easily prepared by the hardening treatment using isocyanate.

In addition, the sliding member according to the exemplary embodiment may be provided with a carbon layer which contains carbon having sp3 bonding without containing a resin on the surface of the carbon containing area, which contacts with the member to be slid. A method of forming the carbon layer is not particularly limited. When the carbon containing area is formed by the direct plasma ion implantation method, a method in which a carbon layer having sp3 bonding is layered to the external side of the carbon containing area by adjusting the ion implantation time is used.

Formation of Carbon Containing Area and Film Formation of Carbon Layer by Pulsed Plasma Ion Implantation Method Here, a pulsed plasma ion implantation method used to form a carbon containing area and a carbon layer with respect to the base material will be described.

In the pulsed plasma ion implantation method, through a complex process in which an ion implantation process by pulsed plasma using at least one or more of ion implantation gases and a film formation process are combined, a carbon containing area is formed on the contact side of the base material with the member to be slid and further a carbon layer is formed on the surface of the carbon containing area which is in contact with the member to be slid. In addition, a surface conditioning process by pulsed plasma may be provided before the complex process is performed.

In the carbon containing area thus formed, carbon having sp3 bonding is bonded with the resin by selecting the type of the resin in the base material and thus a diamond-like carbon (DLC) layer is formed. In addition, the carbon layer formed by the above method also forms the DLC layer in which a carbon having sp3 bonding is layered.

Here, the forming method will be described in more detail.

A plasma generating high frequency power supply and a high voltage pulse generating power supply are connected to the base material in a chamber through a common feedthrough, and a high frequency pulse (pulse RF voltage) is applied to the base material from the plasma generating high frequency power supply to generate plasma in the vicinity of the base material along the external shape thereof. Then, a high negative voltage pulse (DC pulse voltage) is applied at least one time from the high voltage pulse generating power supply to the base material in plasma or afterglow plasma, and the application of the high frequency pulse and the application of the high negative voltage pulse are repeatedly performed. The number of repetitions of application of the high frequency pulse and the high negative voltage pulse may be in a range of from 100 times/second to 5000 times/second.

The width of the high frequency pulse is set to a short pulse of from 2 μs to 200 μs and the width of the high voltage pulse is preferably set to a short pulse of from 0.2 μs to 50 μs. After the elapse of time in range from 10 μs to 300 μs since the high frequency pulse is applied, the high voltage pulse is applied.

In addition, after the high voltage pulse is applied, a low voltage pulse is applied so as to form a carbon layer.

As the gas used in the surface conditioning process, argon, methane or a mixed gas of argon and methane, which each may further include hydrogen, may be used.

As a pulsed plasma ion implantation gas, a methane gas is preferably used.

Further, as a film formation gas, one or more gases selected from the group consisting of ethylene, acetylene, propane, butane, hexane, benzene, chlorobenzene, and toluene are used.

When plasma ions including at least Si ions and C ions separated in the vicinity of the surface of the base material by applying the high voltage pulse are implanted into the base material in a state in which the plasma ions are excited at a kinetic energy of, for example, from 5 keV to 30 keV, while the treatment temperature is prevented from departing from a range of from 50° C. to 100° C., the carbon containing area may be formed in the base material. In addition, the DLC layer, that is, the carbon layer may be deposited on the surface of the carbon containing area within a range of from 0.2 μm to 1.0 μm.

In addition, the carbon containing area and the carbon layer may further include N atoms and F atoms as components in addition to C atoms having sp3 bonding or a Si component.

Due to the fact that N atoms are included, powder is prevented from adhering to the sliding member by friction charging. Further, due to the fact that F atoms are included, the releasability of the sliding portion is improved and thus powder is prevented from adhering to the sliding member.

Examples of the implantation gas used when the N atoms, are contained include a gas obtained by mixing argon, hydrogen, and oxygen, and ammonia gas, or the like.

In addition, examples of the implantation gas used when the F atoms are contained include a gas obtained by mixing hexamethyldisiloxane (HMDSO), acetylene ($C_2H_2$), and fluorocarbon ($C_3F_8$) at a flow ratio of 1:1:0.1, and the like.

It is preferable that the ions are implanted from the side including the portion of the sliding member to be in contact with the member to be slid.

For example, in a case of the cleaning blade 342 shown in FIG. 2, it is preferable that the ions are implanted around the corner portion which contacts with the image holding member (photoreceptor drum) 31 and the corner portion of the surfaces constituting the corner portion, that is, around the contact corner portion 3A and the contact corner portion 3A of the tip end surface 3B and of the front surface 3C constituting the contact corner portion 3A.

The Young's modulus E1 of the contact area is controlled by, for example, adjusting the type of gas, the ion implantation time, the applied voltage, the number of repeated pulses, the width of pulse, and the like in the above-described ion implantation.

Thickness

In the sliding member according to the exemplary embodiment, the contact area may be formed only of the carbon containing area and may be formed of the carbon containing area and the carbon layer as described above.

Therefore, when the contact area is formed only of the carbon containing area, it means that the thickness of the carbon containing area is from 10 nm to 500 nm (the same as the thickness T of the contact area) and when the contact area is formed of the carbon containing area and the carbon layer, it means that the total thickness of the carbon containing area and the carbon layer is from 10 nm to 500 nm.

Only the thickness of the carbon containing area from the contact surface with the member to be slid is preferably from 10 nm to 100 nm.

The thickness of the carbon containing area is controlled by, for example, adjusting the applied voltage, the current, the number of repeated pulses, the width of pulse, the delay time and the like in the above-described ion implantation.

The thickness of the carbon layer is preferably from 0 nm to 400 nm, more preferably from 10 nm to 200 nm, and even more preferably from 10 nm to 100 nm.

When the thickness of the carbon layer is set to 400 nm or less, even in the case in which the carbon layer is flaked off, the flakes are small and thus the member to be slid which the sliding member contacts with is prevented from being damaged by the flakes. From this viewpoint, the thickness is preferable.

The thickness of the carbon layer is controlled by, for example, adjusting the above-described ion implantation time.

Use

The sliding member according to the exemplary embodiment may be suitably used as a cleaning member, particularly, a cleaning blade in an image forming apparatus.

A member to be cleaned (a member to be slid) which is an object to be cleaned by the cleaning blade is not particularly limited as long as the surface of the member needs to be cleaned. Examples thereof include an image holding member (photoreceptor), an intermediate transfer medium, a charging roll, a transfer roll, a recording medium feed belt, a recording medium feed roll, a detoning roll that further removes toner from a cleaning brush which removes toner from an image holding member, and the like.

In addition, as long as the sliding member according to the exemplary embodiment slides on other members in various apparatuses besides the cleaning member (cleaning blade), the sliding member is not particularly limited and may be used for various members. Examples of other uses of the sliding member include the surface of a rotating roller, the surface of a feeding path for a recording medium or the like, the surface of air tight packing, the surface of a sliding pad, a sheet, and the like.

Cleaning Device, Process Cartridge, and Image Forming Apparatus

A cleaning device using the sliding member according to the exemplary embodiment as a cleaning member, a process cartridge, and an image forming apparatus will be described.

The cleaning device according to the exemplary embodiment is not particularly limited as long as the cleaning device includes the sliding member according to the exemplary embodiment as a cleaning member (preferably, a cleaning blade) which is in contact with the surface of the member to be cleaned and cleans the surface of the member to be cleaned.

For example, as a configuration example of the cleaning device, a configuration in which the cleaning blade is fixed in a cleaning case having an opening on the side of the member to be cleaned so that an edge tip end is directed toward the opening and a transport member which introduces a foreign substance such as a waste toner or the like collected from the surface of the member to be cleaned by the cleaning blade to a foreign substance-collecting container is provided may be employed. In addition, the cleaning device according to the exemplary embodiment may include two or more cleaning members according to the exemplary embodiment (preferably, the cleaning blades).

When the cleaning blade formed of the sliding member according to the exemplary embodiment is used for cleaning an intermediate transfer medium such as an intermediate transfer belt, the pressing force (normal force; NF) of the cleaning blade against the intermediate transfer medium is preferably in a range of from 1.2 gf/mm to 3.0 gf/mm and more preferably in a range of from 1.6 gf/mm to 2.5 gf/mm.

In addition, the length of the tip end of the cleaning blade which bites the intermediate transfer medium is preferably in a range of from 0.6 mm to 2.0 mm and more preferably in a range of from 0.9 mm to 1.4 mm.

An angle W/A (working angle) at a portion in which the cleaning blade is in contact with the intermediate transfer medium is preferably in a range of from 8° to 14° and more preferably in a range of from 10° to 12°.

A process cartridge according to the exemplary embodiment is not particularly limited as long as the process cartridge includes the cleaning device according to the exemplary embodiment as a cleaning device which is in contact with one or more members to be cleaned such as image holding members or intermediate transfer mediums and cleans the surface of the member to be cleaned. For example, the process cartridge includes an intermediate transfer medium and the cleaning device according to the exemplary embodiment which cleans the surface of the intermediate transfer medium, and is freely detachable from an image forming apparatus. Further, in addition to the cleaning device according to the exemplary embodiment, a cleaning brush or the like may be used together.

Specific Examples of Image Forming Apparatus and Cleaning Device

Next, specific examples of the cleaning blade formed of the sliding member according to the exemplary embodiment, and an image forming apparatus and a cleaning device using the same will be described in more detail with reference to the drawings.

Figure 4:
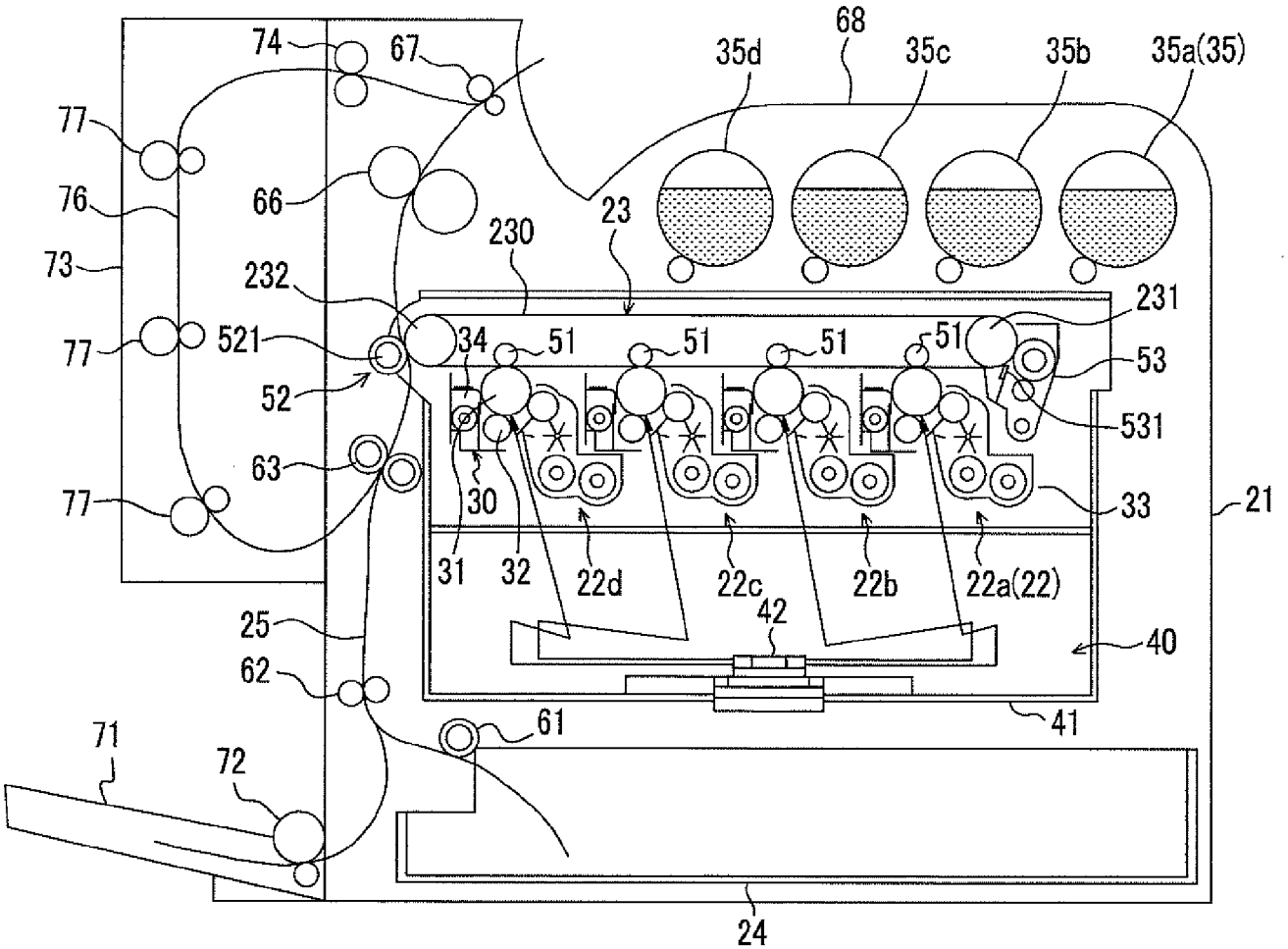
FIG. 4 is a schematic showing an example of an image forming apparatus according to the exemplary embodiment.

FIG. 4 is a schematic view showing an example of the image forming apparatus according to the exemplary embodiment, and shows a so-called tandem type image forming apparatus.

In FIG. 4, the reference number 21 represents a body housing, each of the reference numbers 22 and 22*a* to 22*d* represents an imaging unit, the reference number 23 represents a belt module, the reference number 24 represents a recording medium supply cassette, the reference number 25 represents a recording medium feeding path, the reference number 30 represents each photoreceptor unit, the reference number 31 represents a photoreceptor drum, the reference number 33 represents each developing unit, the reference number 34 represents a cleaning device, each of the reference numbers 35 and 35*a* to 35*d* represents a toner cartridge, the reference number 40 represents an exposure unit, the reference number 41 represents a unit case, the reference number 42 represents a polygon mirror, the reference number 51 represents a primary transfer device, the reference number 52 represents a secondary transfer device, the reference number 53 represents a belt cleaning device, the reference number 61 represents a delivery roll, the reference number 62 represents a feed roll, the reference number 63 represents a positioning roll, the reference number 66 represents a fixing device, the reference number 67 represents a discharge roll, the reference number represents a discharge unit, the reference number 71 represents a manual supply device, the reference number 72 represents a delivery roll, the reference number 73 represents a two-sided recording unit, the reference number 74 represents a guide roll, the reference number 76 represents a feeding path, the reference number 77 represents a feed roll, the reference number 230 represents an intermediate transfer belt, each of the reference numbers 231 and 232 represents a support roll, the reference number 521 represents a secondary transfer roll, and the reference number 531 represents a cleaning blade.

In the tandem type image forming apparatus shown in FIG. 4, the imaging units 22 (specifically, 22*a* to 22*d*) for four colors (in the exemplary embodiment, yellow, magenta, cyan, and black) are arranged in the body housing 21, and the belt module 23 including the intermediate transfer belt 230 which is circularly transported in the arrangement direction of the respective imaging units 22 is installed in an upper part. On the other hand, in the lower part of the body housing 21, the recording medium supply cassette 24 which accommodates, recording mediums (not shown) such as paper is installed. In, addition, the recording medium feeding path 25 which becomes a feeding path for recording mediums from the recording medium supply cassette 24 is installed in a vertical direction.

In the exemplary embodiment, the respective imaging units 22 (22*a* to 22*d*) are used to sequentially form, for example, yellow, magenta, cyan, and black (the arrangement is not necessarily limited to this order) toner images from the upstream side of the intermediate transfer belt 230 in the circulation direction, and provided with the photoreceptor units 30 and the developing units 33, respectively, with one common exposure unit 40.

Here, the photoreceptor unit 30 is formed as a sub-cartridge by integrally forming, for example, the photoreceptor drum 31, a charging device (charging roll) 32 which charges the photoreceptor drum 31 in advance, and the cleaning device 34 which removes a toner remaining on the photoreceptor drum 31 with each other.

In addition, the developing unit 33 develops an electrostatic latent image formed by exposure by the exposure unit 40 on the charged photoreceptor drum 31 with a corresponding color toner (which has, for example, a negative polarity in the exemplary embodiment). For example, the sub-cartridge formed of the photoreceptor unit 30 and the developing unit 33 is formed integrally with each other to constitute the process cartridge (so-called customer replaceable unit).

Needless to say, a single process cartridge may be formed by separating the photoreceptor unit 30 from the developing unit 33. In addition, in FIG. 4, the reference number 35 (35*a* to 35*d*) represents a toner cartridge for replenishing each color component toner to each developing unit 33 (the toner replenishment path is not shown).

On the other hand, the exposure unit 40 stores, for example, four semiconductor lasers (not shown), one polygon mirror 42, an imaging lens (not shown), and mirrors (not shown) corresponding to the respective photoreceptor units 30 in the unit case 41, and is disposed so that light beams from the semiconductor laser for each color component are deflectively scanned by the polygon mirror 42 and an optical image is guided to an exposure point on the corresponding photoreceptor drum 31 through the imaging lens and the mirror.

In addition, in the exemplary embodiment, the belt module 23 is a belt module in which the intermediate transfer belt 230 is put between a pair of support rolls (one roll is a driving roll) 231 and 232. The primary transfer device (primary transfer roll in this example) 51 is installed on a rear surface of the intermediate transfer belt 230 corresponding to the photoreceptor drums 31 of each of the photoreceptor units 30, and a voltage whose polarity is opposite the charging polarity of the toner is applied to the primary transfer device 51 to electrostatically transfer the toner image on the photoreceptor drum 31 onto the intermediate transfer belt 230. Further, the secondary transfer device 52 is installed on a site corresponding to the support roll 232 on the downstream side of the downmost-stream imaging unit 22*d* of the intermediate transfer belt 230, and the primarily-transferred image on the intermediate transfer belt 230 is secondarily transferred (collectively transferred) onto a recording medium.

In the exemplary embodiment, the secondary transfer device 52 is provided with the secondary transfer roll 521 which is disposed to be in pressure-contact with a toner image holding surface of the intermediate transfer belt 230 and the rear roll (which is also the support roll 232 in this example) which is disposed on the rear surface side of the intermediate transfer belt 230 to form a counter electrode of the secondary transfer roll 521. In addition, for example, the secondary transfer roll 521 is grounded and a bias whose polarity is the same as the charging polarity of the toner is applied to the rear roll (support roll 232).

Further, the belt cleaning device 53 is installed on the upstream side of the uppermost-stream imaging unit 22*a* of the intermediate transfer belt 230, and removes a toner remaining on the intermediate transfer belt 230. As the cleaning blade 531 used in the belt cleaning device 53, the cleaning blade formed of the sliding member according to the exemplary embodiment is used.

In addition, the recording medium supply cassette 24 is provided with the delivery roll 61 which delivers a recording medium. Right behind the delivery roll 61, the feed roll 62 is installed to deliver the recording medium and the registration roll (positioning roll) 63 is installed on the recording medium feeding path 25 positioned right in front of the secondary transfer site to supply the recording medium to the secondary transfer site at a predetermined timing. On the other hand, the recording medium feeding path 25 positioned on the downstream side of the secondary transfer site is provided with the fixing device 66, the discharge roll 67 for discharging the recording medium is provided on the downstream side of the fixing device 66, and the discharge unit 68 formed in the upper part of the body housing 21 accommodates discharged recording medium.

Further, in the exemplary embodiment, the manual supply device 71 is provided on the side of the body housing 21 and a recording medium on the manual supply device 71 is delivered toward the recording medium feeding path 25 by the delivery roll 72 and the feed roll 62.

Furthermore, the body housing 21 is provided with the two-sided recording unit 73 attached thereto. When two-sided recording mode in which image recording is performed on two sides of a recording medium is selected, the two-sided recording unit 73 reversely rotates the discharge roll 67 to take a recording medium with one surface on which the recording has ended inward by the guide roll 74 immediately before the inlet port, to thereby transport the recording medium along the internal recording medium returning feeding path 76 by the feed roll 77 and supply the recording medium to the positioning roll 63 again.

Next, the cleaning device 39 which is disposed in the tandem type image forming apparatus shown in FIG. 4 will be described in detail.

Figure 5:
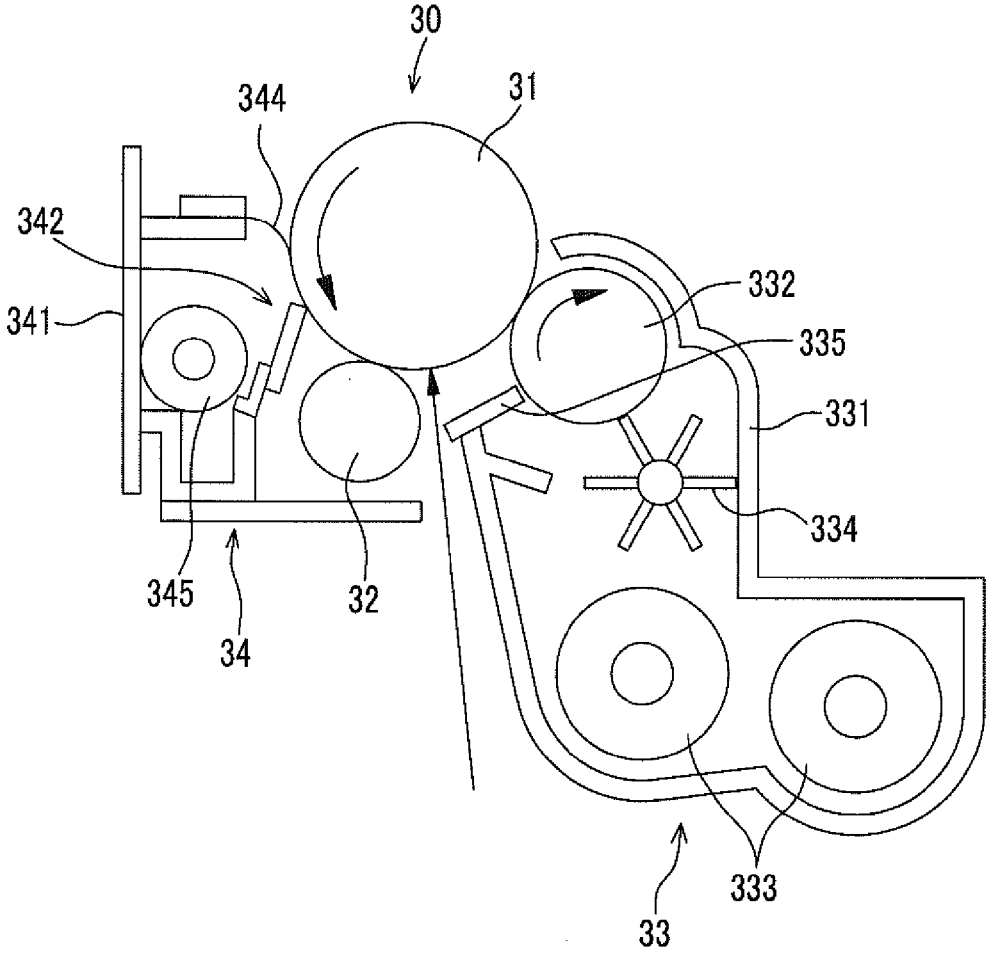
FIG. 5 is a schematic cross-sectional view showing an example of a cleaning device according to the exemplary embodiment.

FIG. 5 is a schematic cross-sectional view showing an example of the cleaning device according to the exemplary embodiment. FIG. 5 shows the photoreceptor drum 31, the charging roll 32, and the developing unit 33, which are formed integrally with each other as a sub-cartridge, together with the cleaning device 34 shown in FIG. 4.

In FIG. 5, the reference number 32 represents a charging roll (charging device), the reference number 331 represents a unit case, the reference number 332 represents a developing roll, the reference number 333 represents a toner transport member, the reference number 334 represents a transport paddle, the reference number 335 represents a developer layer trimming member, the reference number 341 represents a cleaning case, the reference number 342 represents a cleaning blade, the reference number 344 represents a film seal, and the reference number 345 represents a transport member.

The cleaning device 34 has the cleaning case 341 which accommodates a residual toner and has an opening facing the photoreceptor drum 31. While the cleaning blade 342 which is disposed to be in contact with the photoreceptor drum 31 is attached to the lower edge of the opening of the cleaning case 341 with a bracket (not shown) interposed therebetween, the film seal 344 is attached to the upper edge of the opening of the cleaning case 341 to maintain a space between the photoreceptor drum 31 and the cleaning case 341 in an airtight manner. The reference number 345 represents a transport member which guides a waste toner accommodated in the cleaning case 341 to a waste toner container on the side.

In the exemplary embodiment, in all of the cleaning devices 34 of the respective imaging units 22 (22*a* to 22*d*), the cleaning blade formed of the sliding member according to the exemplary embodiment is used as the cleaning blade 342. In addition, the cleaning blade formed of the sliding member according to the exemplary embodiment may be used as the cleaning blade 531 used in the belt cleaning device 53.

The developing unit (developing device) 33 which is used in the exemplary embodiment has, for example, the unit case 331 which accommodates a developer and has an opening facing the photoreceptor drum 31 as shown in FIG. 5. Here, the developing roll 332 is installed at a position facing the opening of the unit case 331, and in the unit case 331, the toner transport member 333 is installed for agitating and transporting a developer. Furthermore, the transport paddle 334 may be installed between the developing roll 332 and the toner transport member 333.

In the developing, a developer is supplied to the developing roll 332 and then for example, in a state in which developer is regulated by the developer layer trimming member 335, the developer is transported to a developing area facing the photoreceptor drum 31.

In the exemplary embodiment, for example, a two-component developer formed of a toner and a carrier, or a single-component developer formed only of a toner may be used for the developing unit 33.

Next, the operation of the image forming apparatus according to the exemplary embodiment will be described. First, after each of the imaging units 22 (22*a* to 22*d*) forms a single-color toner image corresponding to each color, the single-color toner images of the respective colors are primarily transferred onto the surface of the intermediate transfer belt 230 to sequentially overlap each other so as to be matched with the original information. Next, the color toner image transferred onto the surface of the intermediate transfer belt 230 is transferred onto a surface of a recording medium by the secondary transfer device 52, and the recording medium having the color toner image transferred thereonto is subjected to a fixing process by the fixing device 66, and then discharged to the discharge unit 68.

In the respective imaging units 22 (22*a* to 22*d*), the toner remaining on the photoreceptor drum 31 is cleaned by the cleaning device 39 and the toner remaining on the intermediate transfer belt 230 is cleaned by the belt cleaning device 53.

In such an image forming process, each residual toner is cleaned by the cleaning device 34 and the belt cleaning device 53.

The cleaning blade 342 may be directly fixed to the frame member in the cleaning device 34 as shown in FIG. 5, or may be fixed to the frame member with a spring member interposed therebetween.

EXAMPLES

Hereinafter, the invention will be described using Examples, but is not limited only to the examples. In the following description, "parts" means "parts by weight".

Example 1

Preparation of Base Material not Having Contact Area

First, a mixture of polycaprolactone polyol (manufactured by Daicel Corporation, PLACCEL 205, average molecular weight: 529, hydroxyl value: 212 KOH mg/g), polycaprolactone polyol (manufactured by Daicel Corporation, PLACCEL 240, average molecular weight: 4155, hydroxyl value: 27 KOH mg/g), and polyester polyol (adipic acid polyester, manufactured by Hitachi Chemical Co., Ltd, Teslac 2464, average molecular weight: 1000, hydroxyl value: 110 KOH mg/g to 120 KOH mg/g) (PLACCEL 205:PLACCEL 240: Teslac 2464=4:2:4 (weight ratio)) is used as a soft segment material of a polyol component. In addition, an acrylic resin (manufactured by Soken Chemical Engineering Co., Ltd., Actflow UMB-2005B) including two or more hydroxyl groups is used as a hard segment material, and the soft segment material and the hard segment material are mixed at a ratio of 8:2 (weight ratio).

Next, 6.26 parts of 4,4'-diphenylmethane diisocyanate (manufactured by Nippon Polyurethane Industry Co., Ltd., MILLIONATE MT) as an isocyanate compound is added with respect to 100 parts of the mixture of the soft segment material and the hard segment material, and the obtained mixture is allowed to react for 3 hours at 70° C. under a nitrogen atmosphere. The amount of the isocyanate compound used in the reaction is selected so that a ratio (isocyanate group/hydroxyl group) of the isocyanate group to the hydroxyl group included in the reaction system is 0.5.

Next, 34.3 parts of the isocyanate compound is further added and the obtained mixture is allowed to react for 3 hours at 70° C. under a nitrogen atmosphere to obtain a prepolymer. The total amount of the isocyanate compound used at the time of using the prepolymer is 40.56 parts.

Next, the prepolymer is heated to 100° C. and defoamed for 1 hour under a reduced pressure. Thereafter, 7.14 parts of a mixture of 1,4-butanediol (chain extender) and trimethylolpropane (crosslinking agent) (weight ratio=60/40) is added with respect to 100 parts of the prepolymer and mixed therewith for 3 minutes so that bubbles are not formed, whereby a base material forming composition A is prepared.

Next, the base material forming composition A is poured into a centrifugal molding machine with the mold adjusted to 140° C., and subjected to a hardening reaction for 1 hour. Next, aging heating is performed for 24 hours at 110° C., cooling is then performed, and cutting is performed to obtain a base material. A having a length of 320 mm, a width of 12 mm, and a thickness of 2 mm.

Formation of Carbon Containing Area and Formation of Carbon Layer

A carbon containing area is formed by implanting carbon ions having sp3 bonding by a pulsed plasma ion implantation method into the contact side (contact corner portion) of the base material A with the member to be slid and a carbon layer is formed on the external side of the carbon containing area (on the contact surface with the member to be slid).

Hereinafter, a specific pulsed plasma ion implantation method will be described.

Carbon ions are mainly implanted into the base material A by applying a high voltage pulse (from 15 kV to 35 kV) to the base material A in methane gas plasma. Thus, the carbon ions cut bonding between carbons or bonding between carbon and hydrogen in the base material A formed of rubber and substitution with carbon or hydrogen in the rubber is performed. As a result, a carbon containing area in which carbon atoms are implanted to a depth of at least 0.1 μm or more from the base material A is formed.

Here, in order to enhance the infiltration into the carbon containing area, the gas pressure is increased (in a range of from 0.5 Pa to 2 Pa), and the number of repetitions of applications of the high voltage pulse (from 2000 pps to 10000 pps) is increased as much as possible. Next, the output of discharge plasma is set to 700 W and 4 kV of a low voltage pulse to be applied to the base material A in toluene gas plasma is applied for 10 minutes. Thus, a carbon layer is formed on the surface of the carbon containing area of the base material A.

Before the ion implantation process, a surface conditioning process by pulsed plasma may be provided.

In this manner, a cleaning blade 1 of Example 1 is obtained.

Examples 2

A base material forming composition B is prepared in the same manner as in the preparation of the base material forming composition A of Example 1 except that polytetramethylene ether glycol (manufactured by Hodogaya Chemical Co., Ltd., PTMG 2000SN, molecular weight: 2000, hydroxyl value: 56.1 KOH mg/g) is used as polyol and components are blended so that the ratio of each component is 88 mol % of polyol, 4.1 mol % of a chain extender, 7.2 mol % of an isocyanate compound, and 0.7 mol % of a crosslinking agent. A base material B is prepared in the same method and conditions as in Example 1 using the base material forming composition B. Here, when the base material forming composition B is prepared, about 15% by weight of the total blending amount of the isocyanate compound with respect to the mixture of the soft segment material and hard segment material is used in advance and the obtained mixture is allowed to react for 3 hours and then, the rest of the amount of isocyanate compound is additionally added thereto.

A carbon containing area and a carbon layer are formed on the contact side (contact corner portion) of the prepared base material B with the member to be slid in the same manner as in Example 1 except that the discharge plasma output is set to 700 W and 4.5 kV of a low voltage pulse is applied to the base material B in toluene gas plasma for 13 minutes.

In this manner, a cleaning blade 2 of Example 2 is obtained.

Example 3

A base material forming composition C is prepared in the same manner as in the preparation of the base material forming composition A of Example 1 except that polytetramethylene ether glycol (manufactured by Hodogaya Chemical Co., Ltd., PTMG 2000SN, molecular weight: 2000, hydroxyl value: 56.1 KOH mg/g) is used as polyol and components are blended so that the ratio of each component is 86.6 mol % of polyol, 4.5 mol % of a chain extender, 8.2 mol % of an isocyanate compound, and 0.7 mol % of a crosslinking agent. A base material C is prepared in the same method and conditions as in Example 1 using the base material forming composition C. Here, when the base material forming composition C is prepared, about 15% by weight of the total blending amount of the isocyanate compound with respect to the mixture of the soft segment material and hard segment material is used in advance and the obtained mixture is allowed to react for 3 hours and then, the rest of the amount of isocyanate compound is additionally added thereto.

A carbon containing area and a carbon layer are formed on the contact side (contact corner portion) of the prepared base material C with the member to be slid in the same manner as in Example 1 except that the discharge plasma output is set to 700 W and 5 kV of a low voltage pulse is applied to the base material C in toluene gas plasma for 13 minutes.

In this manner, a cleaning blade 3 of Example 3 is obtained.

Example 4

A base material forming composition D is prepared in the same manner as in the preparation of the base material forming composition A of Example 1 except that a mixture of polycaprolactone polyol (manufactured by Daicel Corporation, PLACCEL 205, average molecular weight: 529, hydroxyl value: 212 KOH mg/g) and polycaprolactone polyol (manufactured by Daicel Corporation, PLACCEL 240, average molecular weight: 4155, hydroxyl value: 27 KOH mg/g) (PLACCEL 205:PLACCEL 240=5:5 (weight ratio)) is used as polyol and components are blended so that the ratio of each component is 72 mol % of polyol, 5.5 mol % of a chain extender, 19.2 mol % of an isocyanate compound, and 3.3 mol % of a crosslinking agent. A base material D is prepared in the same method and conditions as in Example 1 using the base material forming composition D. Here, when the base material forming composition D is prepared, about 15% by weight of the total blending amount of the isocyanate compound with respect to the mixture of the soft segment material and hard segment material is used in advance and the obtained mixture is allowed to react for 3 hours and then, the rest of the amount of isocyanate compound is additionally added thereto.

A carbon containing area and a carbon layer are formed on the contact side (contact corner portion) of the prepared base material D with the member to be slid in the same manner as in Example 1 except that the discharge plasma output is set to 1 kW and 5 kV of a low voltage pulse is applied to the base material D in mixed gas plasma of toluene and acetylene (molar ratio 8:2) for 15 minutes.

In this manner, a cleaning blade 4 of Example 4 is obtained.

Example 5

A base material forming composition E is prepared in the same manner as in the preparation of the base material forming composition A of Example 1 except that a mixture of polycaprolactone polyol (manufactured by Daicel Corporation, PLACCEL 205, average molecular weight: 529, hydroxyl value: 212 KOH mg/g) and polycaprolactone polyol (manufactured by Daicel Corporation, PLACCEL 240, average molecular weight: 4155, hydroxyl value: 27 KOH mg/g) (PLACCEL 205:PLACCEL 240=4:6 (weight ratio)) is used as polyol, a mixture of 1,4-butanediol and ethylene glycol (1,4-butanediol:ethylene glycol=5:5 (weight ratio)) is used as a chain extender, and components are blended so that the ratio of each component is 72 mol % of polyol, 3.3 mol % of a chain extender, 23 mol % of an isocyanate compound, and 1.7 mol % of a crosslinking agent. A base material E is prepared in the same method and conditions as in Example 1 using the base material forming composition E. Here, when the base material forming composition E is prepared, about 15% by weight of the total blending amount of the isocyanate compound with respect to the mixture of the soft segment material and hard segment material is used in advance and the obtained mixture is allowed to react for 3 hours and then, the rest of the amount of isocyanate compound is additionally added thereto.

A carbon containing area and a carbon layer are formed on the contact side (contact corner portion) of the prepared base material E with the member to be slid in the same manner as in Example 1 except that the discharge plasma output is set to 1 kW and 7 kV of a low voltage pulse is applied to the base material E in mixed gas plasma of toluene and acetylene (molar ratio 1:1) for 20 minutes.

In this manner, a cleaning blade 5 of Example 5 is obtained.

Example 6

A base material forming composition F is prepared in the same manner as in the preparation of the base material forming composition A of Example 1 except that a mixture of polycaprolactone polyol (manufactured by Daicel Corporation, PLACCEL 205, average molecular weight: 529, hydroxyl value: 212 KOH mg/g), polycaprolactone polyol (manufactured by Daicel Corporation, PLACCEL 240, average molecular weight: 4155, hydroxyl value: 27 KOH mg/g), and polyester polyol (adipic acid polyester, manufactured by Hitachi Chemical Co., Ltd, Teslac 2464, average molecular weight: 1000, hydroxyl value: 110 KOH mg/g to 120 KOH mg/g) (PLACCEL 205:PLACCEL 240: Teslac 2464=4:3:3 (weight ratio)) is used as polyol and components are blended so that the ratio of each component is 62 mol % of polyol, 9.7 mol % of a chain extender, 20 mol % of an isocyanate compound, and 8.3 mol % of a crosslinking agent. A base material F is prepared in the same method and conditions as in Example 1 using the base material forming composition F. Here, when the base material forming composition F is prepared, about 15% by weight of the total blending amount of the isocyanate compound with respect to the mixture of the soft segment material and hard segment material is used in advance and the obtained mixture is allowed to react for 3 hours and then, the rest of the amount of isocyanate compound is additionally added thereto.

A carbon containing area and a carbon layer are formed on the contact side (contact corner portion) of the prepared base material F with the member to be slid in the same manner as in Example 1 except that the discharge plasma output is set to 1.5 kW and 10 kV of a low voltage pulse is applied to the base material F in mixed gas plasma of methane and acetylene (molar ratio 3:7) for 20 minutes.

In this manner, a cleaning blade 6 of Example 6 is obtained.

Example 7

A base material forming composition G is prepared in the same manner as in the preparation of the base material forming composition A of Example 1 except that polytetramethylene ether glycol (manufactured by Hodogaya Chemical Co., Ltd., PTMG 2000SN, molecular weight: 2000, hydroxyl value: 56.1 KOH mg/g) is used as polyol and components are blended so that the ratio of each component is 83.3 mol % of polyol, 4.7 mol % of a chain extender, 11.1 mol % of an isocyanate compound, and 0.9 mol % of a crosslinking agent. A base material G is prepared in the same method and conditions as in Example 1 using the base material forming composition G. Here, when the base material forming composition G is prepared, about 15% by weight of the total blending amount of the isocyanate compound with respect to the mixture of the soft segment material and hard segment material is used in advance and the obtained mixture is allowed to react for 3 hours and then, the rest of the amount of isocyanate compound is additionally added thereto.

A carbon containing area and a carbon layer are formed on the contact side (contact corner portion) of the prepared base material G with the member to be slid in the same manner as in Example 1 except that the discharge plasma output is set to 1.5 kW and 15 kV of a low voltage pulse is applied to the base material G in mixed gas plasma of methane and acetylene (molar ratio 3:7) for 30 minutes.

In this manner, a cleaning blade 7 of Example 7 is obtained.

Example 8

A base material forming composition H is prepared in the same manner as in the preparation of the base material forming composition A of Example 1 except that polytetramethylene ether glycol (manufactured by Hodogaya Chemical Co., Ltd., PTMG 2000SN, molecular weight: 2000, hydroxyl value: 56.1 KOH mg/g) is used as polyol and components are blended so that the ratio of each component is 85.1 mol % of polyol, 3.7 mol % of a chain extender, 10.3 mol % of an isocyanate compound, and 0.9 mol % of a crosslinking agent. A base material H is prepared in the same method and conditions as in Example 1 using the base material forming composition H. Here, when the base material forming composition H is prepared, about 15% by weight of the total blending amount of the isocyanate compound with respect to the mixture of the soft segment material and hard segment material is used in advance and the obtained mixture is allowed to react for 3 hours and then, the rest of the amount of isocyanate compound is additionally added thereto.

A carbon containing area and a carbon layer are formed on the contact side (contact corner portion) of the prepared base material H with the member to be slid in the same manner as in Example 1 except that the discharge plasma output is set to 1.5 kW and 19 kV of a low voltage pulse is applied to the base material H in mixed gas plasma of methane and acetylene (molar ratio 3:7) for 30 minutes.

In this manner, a cleaning blade 8 of Example 8 is obtained.

Example 9

A base material forming composition I is prepared in the same manner as in the preparation of the base material forming composition A of Example 1 except that a mixture of polycaprolactone polyol (manufactured by Daicel Corporation, PLACCEL 205, average molecular weight: 529, hydroxyl value: 212 KOH mg/g), polycaprolactone polyol (manufactured by Daicel Corporation, PLACCEL 240, average molecular weight: 4155, hydroxyl value: 27 KOH mg/g), and polyester polyol (adipic acid polyester, manufactured by Hitachi Chemical Co., Ltd, Teslac 2464, average molecular weight: 1000, hydroxyl value: 110 KOH mg/g to 120 KOH mg/g) (PLACCEL 205: PLACCEL 240: Teslac 2464=2:4:4 (weight ratio)) is used as polyol and components are blended so that the ratio of each component is 72 mol % of polyol, 6.7 mol % of a chain extender, 17 mol % of an isocyanate compound, and 4.3 mol % of a crosslinking agent. A base material I is prepared in the same method and conditions as in Example 1 using the base material forming composition I. Here, when the base material forming composition I is prepared, about 15% by weight of the total blending amount of the isocyanate compound with respect to the mixture of the soft segment material and hard segment material is used in advance and the obtained mixture is allowed to react for 3 hours and then, the rest of the amount of isocyanate compound is additionally added thereto.

A carbon containing area and a carbon layer are formed on the contact side (contact corner portion) of the prepared base material I with the member to be slid in the same manner as in Example 1 except that the discharge plasma output is set to 700 W and 4.5 kV of a low voltage pulse is applied to the base material I in toluene gas plasma for 11 minutes.

In this manner, a cleaning blade 9 of Example 9 is obtained.

Example 10

A base material forming composition J is prepared in the same manner as in the preparation of the base material forming composition A of Example 1 except that polytetramethylene ether glycol (manufactured by Hodogaya Chemical Co., Ltd., PTMG 2000SN, molecular weight: 2000, hydroxyl value: 56.1 KOH mg/g) is used as polyol and components are blended so that the ratio of each component is 80.8 mol % of polyol, 5.2 mol % of a chain extender, 12.7 mol % of an isocyanate compound, and 1.3 mol % of a crosslinking agent. A base material J is prepared in the same method and conditions as in Example 1 using the base material forming composition J. Here, when the base material forming composition J is prepared, about 15% by weight of the total blending amount of the isocyanate compound with respect to the mixture of the soft segment material and hard segment material is used in advance and the obtained mixture is allowed to react for 3 hours and then, the rest of the amount of isocyanate compound is additionally added thereto.

A carbon containing area and a carbon layer are formed on the contact side (contact corner portion) of the prepared base material J with the member to be slid in the same manner as in Example 1 except that the discharge plasma output is set to 1 kW and 5 kV of a low voltage pulse is applied to the base material J in mixed gas plasma of toluene and acetylene (molar ratio 7:3) for 15 minutes.

In this manner, a cleaning blade 10 of Example 10 is obtained.

Example 11

A base material forming composition K is prepared in the same manner as in the preparation of the base material forming composition A of Example 1 except that polytetramethylene ether glycol (manufactured by Hodogaya Chemical Co., Ltd., PTMG 2000SN, molecular weight: 2000, hydroxyl value: 56.1 KOH mg/g) is used as polyol and components are blended so that the ratio of each component is 89 mol % of polyol, 3.7 mol % of a chain extender, 6.7 mol % of an isocyanate compound, and 0.6 mol % of a crosslinking agent. A base material K is prepared in the same method and conditions as in Example 1 using the base material forming composition K. Here, when the base material forming composition K is prepared, about 15% by weight of the total blending amount of the isocyanate compound with respect to the mixture of the soft segment material and hard segment material is used in advance and the obtained mixture is allowed to react for 3 hours and then, the rest of the amount of isocyanate compound is additionally added thereto.

Only a carbon containing area is formed on the contact side (contact corner portion) of the prepared base material K with the member to be slid in the same manner as in Example 1 except that the discharge plasma output is set to 700 W and 5 kV of a low voltage pulse is applied to the base material K in mixed gas plasma of hexamethyldisiloxane and methane (molar ratio 1:1) for 5 minutes.

In this manner, a cleaning blade 11 of Example 11 is obtained.

Comparative Example 1

A base material forming composition L is prepared in the same manner as in the preparation of the base material forming composition A of Example 1 except that a mixture of polycaprolactone polyol (manufactured by Daicel Corporation, PLACCEL 205, average molecular weight: 529, hydroxyl value: 212 KOH mg/g), polycaprolactone polyol (manufactured by Daicel Corporation, PLACCEL 240, average molecular weight: 4155, hydroxyl value: 27 KOH mg/g), and polyester polyol (adipic acid polyester, manufactured by Hitachi Chemical Co., Ltd, Teslac 2464, average molecular weight: 1000, hydroxyl value: 110 KOH mg/g to 120 KOH mg/g) (PLACCEL 205:PLACCEL 240: Teslac 2464=3:4:3 (weight ratio)) is used as polyol and components are blended so that the ratio of each component is 72 mol % of polyol, 6.7 mol % of a chain extender, 17 mol % of an isocyanate compound, and 4.3 mol % of a crosslinking agent. A base material L is prepared in the same method and conditions as in Example 1 using the base material forming composition L. Here, when the base material forming composition L is prepared, about 15% by weight of the total blending amount of the isocyanate compound with respect to the mixture of the soft segment material and hard segment material is used in advance and the obtained mixture is allowed to react for 3 hours and then, the rest of the amount of isocyanate compound is additionally added thereto.

A carbon containing area and a carbon layer are formed on the contact side (contact corner portion) of the prepared base material L with the member to be slid in the same manner as in Example 1 except that the discharge plasma output is set to 700 W and 4 kV of a low voltage pulse is applied to the base material L in mixed gas plasma of toluene and acetylene (molar ratio 7:3) for 7 minutes.

In this manner, a cleaning blade C1 of Comparative Example 1 is obtained.

Comparative Example 2

A base material M is prepared in the same manner as in the preparation of the base material A of Example 1.

A carbon containing area and a carbon layer are formed on the contact side (contact corner portion) of the prepared base material M with the member to be slid in the same manner as in Example 1 except that the discharge plasma output is set to 700 W and 3 kV of a low voltage pulse is applied to the base material M in toluene gas plasma for 8 minutes.

In this manner, a cleaning blade C2 of Comparative Example 2 is obtained.

Comparative Example 3

A base material forming composition N is prepared in the same manner as in the preparation of the base material forming composition A of Example 1 except that polytetramethylene ether glycol (manufactured by Hodogaya Chemical Co., Ltd., PTMG 2000SN, molecular weight: 2000, hydroxyl value: 56.1 KOH mg/g) is used as polyol and components are blended so that the ratio of each component is 86.2 mol % of polyol, 3.2 mol % of a chain extender, 9.7 mol % of an isocyanate compound, and 0.9 mol % of a crosslinking agent. A base material N is prepared in the same method and conditions as in Example 1 using the base material forming composition N. Here, when the base material forming composition N is prepared, about 15% by weight of the total blending amount of the isocyanate compound with respect to the mixture of the soft segment material and hard segment material is used in advance and the obtained mixture is allowed to react for 3 hours and then, the rest of the amount of isocyanate compound is additionally added thereto.

A carbon containing area and a carbon layer are formed on the contact side (contact corner portion) of the prepared base material N with the member to be slid in the same manner as in Example 1 except that the discharge plasma output is set to 2 kW and 20 kV of a low voltage pulse is applied to the base material N in mixed gas plasma of methane and acetylene (molar ratio 3:7) for 32 minutes.

In this manner, a cleaning blade C3 of Comparative Example 3 is obtained.

Comparative Example 4

A base material forming composition O is prepared in the same manner as in the preparation of the base material forming composition A of Example 1 except that polytetramethylene ether glycol (manufactured by Hodogaya Chemical Co., Ltd., PTMG 2000SN, molecular weight: 2000, hydroxyl value: 56.1 KOH mg/g) is used as polyol and components are blended so that the ratio of each component is 79.5 mol % of polyol, 6.2 mol % of a chain extender, 13 mol % of an isocyanate compound, and 1.3 mol % of a crosslinking agent. A base material O is prepared in the same method and conditions as in Example 1 using the base material forming composition O. Here, when the base material forming composition O is prepared, about 15% by weight of the total blending amount of the isocyanate compound with respect to the mixture of the soft segment material and hard segment material is used in advance and the obtained mixture is allowed to react for 3 hours and then, the rest of the amount of isocyanate compound is additionally added thereto.

A carbon containing area and a carbon layer are formed on the contact side (contact corner portion) of the prepared base material O with the member to be slid in the same manner as in Example 1 except that the discharge plasma output is set to 2 kW and 25 kV of a low voltage pulse is applied to the base material O in mixed gas plasma of methane and acetylene (molar ratio 3:7) for 35 minutes.

In this manner, a cleaning blade C4 of Comparative Example 4 is obtained.

Comparative Example 5

A base material forming composition P is prepared in the same manner as in the preparation of the base material forming composition A of Example 1 except that polytetramethylene ether glycol (manufactured by Hodogaya Chemical Co., Ltd., PTMG 2000SN, molecular weight: 2000, hydroxyl value: 56.1 KOH mg/g) is used as polyol and components are blended so that the ratio of each component is 88 mol % of polyol, 3.7 mol % of a chain extender, 7.9 mol % of an isocyanate compound, and 0.4 mol % of a crosslinking agent. A base material P is prepared in the same method and conditions as in Example 1 using the base material forming composition P. Here, when the base material forming composition P is prepared, about 15% by weight of the total blending amount of the isocyanate compound with respect to the mixture of the soft segment material and hard segment material is used in advance and the obtained mixture is allowed to react for 3 hours and then, the rest of the amount of isocyanate compound is additionally added thereto.

A carbon containing area and a carbon layer are formed on the contact side (contact corner portion) of the prepared base material P with the member to be slid in the same manner as in Example 1 except that the discharge plasma output is set to 2 kW and 22 kV of a low voltage pulse is applied to the base material P in mixed gas plasma of methane and acetylene (molar ratio 3:7) for 30 minutes.

In this manner, a cleaning blade C5 of Comparative Example 5 is obtained.

Evaluation Tests

Measurement of Young's Modulus E1, Thickness T, and Young's Modulus E2

The Young's modulus E1, thickness T, and Young's modulus E2 of the cleaning blade obtained in each of Examples and Comparative Examples are measured by the above-described manner.

The results are shown in Table 1.

Chip Occurrence Test

In the following method, a degree (grade) of occurrence of chips is evaluated.

The cleaning blade obtained in each of Examples and Comparative Examples is mounted on a DocuCentre-IV C5575 manufactured by Fuji Xerox Co., Ltd., and printing is performed on 10,000 sheets of paper at a working angle (W/A) of 11° with a normal force (NF) of 1.3 gf/mm.

After the printing ends, a degree (grade) of occurrence of chips in the cleaning blade is evaluated through the size and the number of chips in the contact corner portion according to the following criteria.

The degree (grade) of occurrence of chips is measured at a center site of the contact corner portion in an axial direction in a range of 100 mm.

Evaluation Criteria

G1: No chip occurred

G2: Chip size of 1 μm or less and chip number of 1 or more and less than 5

G3: Chip size of 1 μm or less and chip number of 5 or more and less than 10

G4: Chip size of 1 μm or less and chip number of 10 or more

G5: Chip size of greater than 1 μm and 5 μm or less and chip number of 1 or more and less than 5

G6: Chip size of greater than 1 μm and 5 μm or less and chip number of 5 or more and less than 10

G7: Chip size of greater than 1 μm and 5 μm or less and chip number of 10 or more G8: Chip size of greater than 5 μm and chip number of 1 or more and less than 5

G9: Chip size of greater than 5 μm and chip number of 5 or more and less than 10

G10: Chip size of greater than 5 μm and chip number of 10 or more

Occurrence of Cleaning Failure

In the evaluation of cleaning failure, after the above chip occurrence test ends, the A3-sized paper on which an untransferred solid image (solid image size: 400 mm×290 mm) is formed is supplied between the photoreceptor drum and the cleaning blade, the apparatus is stopped immediately after the final end portion of the untransferred solid image in the transportation direction is passed through the contact portion of the photoreceptor drum and the cleaning blade, and the passing of the toner is visually checked. The case in which the passing is observed is determined as the cleaning failure.

In a case in which a portion of stopping the toner is lost by abrasion or chips of the edge portion (contact corner portion), since cleaning failure easily occurs in the above-described test as the edge abrasion depth or chip depth becomes larger, the test is useful in the qualitative evaluation for abrasion and chips in the edge portion (contact corner portion).

Evaluation Criteria

A: No toner passing occurred

B: Allowable level of toner passing occurred

C: Toner passing occurred at a level of causing problems in image quality

TABLE 1

| | Examples | | | | | | | | | | |
|---|---|---|---|---|---|---|---|---|---|---|---|
| Blade No. | 1 | 2 | 3 | 4 | 5 | 6 | 7 | 8 | 9 | 10 | 11 |
| Young's modulus E1 (MPa) | 10 | 61 | 95 | 316 | 8,800 | 40,000 | 130,000 | 200,000 | 15 | 680 | 12 |
| Thickness T (nm) | 160 | 200 | 210 | 230 | 300 | 380 | 460 | 490 | 170 | 250 | 100 |
| Young's modulus E2 (MPa) | 1 | 9 | 14 | 140 | 170 | 230 | 500 | 460 | 0.7 | 560 | 6 |
| Carbon layer | Formed | Formed | Formed | Formed | Formed | Formed | Formed | Formed | Formed | Formed | Not formed |
| Degree of occurrence of chips | G2 | G1 | G1 | G1 | G2 | G3 | G3 | G4 | G6 | G6 | G2 |
| Cleaning failure | A | A | A | A | A | A | A | B | B | B | A |

| | Comparative Example | | | | |
|---|---|---|---|---|---|
| Blade No. | C1 | C2 | C3 | C4 | C5 |
| Young's modulus E1 (MPa) | 5 | 8 | 210,000 | 260,000 | 215,000 |
| Thickness T (nm) | 120 | 135 | 510 | 540 | 490 |
| Young's modulus E2 (MPa) | 0.7 | 1 | 430 | 580 | 80 |
| Carbon layer | Formed | Formed | Formed | Formed | Formed |
| Degree of occurrence of chips | G8 | G7 | G8 | G9 | G8 |
| Cleaning failure | C | C | C | C | C |

As described above, according to the cleaning blade of each Example, it is found that no chip occurs or a smaller number of chips occur compared to the cleaning blade of each Comparative Example.

In addition, it is found that toner passing occurs at a level of causing problems in an image quality in the cleaning blade of each Comparative Example.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sliding member comprising:

a base material including a contact area which contacts with a member to be slid, wherein a Young's modulus E1 with respect to the thickness of the contact area from a surface of the contact area is from 10 MPa to 200,000 MPa, wherein a Young's modulus E2 of the base material at a site where a distance from the surface of the contact area exceeds the thickness of the contact area is from 1 MPa to 500 MPa, the Young's modulus E1 and the Young's modulus E2 satisfy a relationship of E2<E1, and a thickness T of the contact area is from 10 nm to 500 nm.

2. The sliding member according to claim 1, wherein the Young's modulus E1 with respect to the thickness of the contact area from the surface of the contact area is from 30 MPa to 9,000 MPa.

3. The sliding member according to claim 1, wherein the thickness T of the contact area is from 150 nm to 300 nm.

4. The sliding member according to claim 1, wherein the Young's modulus E2 of the base material at a site where a distance from the surface of the contact area exceeds the thickness of the contact area is from 8 MPa to 50 MPa.

5. The sliding member according to claim 1, wherein the base material including the contact area contains a resin over the whole area.

6. The sliding member according to claim 5, wherein the contact area of the base material is a carbon containing area which contains the resin and carbon having sp3 bonding.

7. The sliding member according to claim 1, wherein the contact area of the base material includes a carbon containing area containing a resin and carbon having sp3 bonding, and a carbon layer containing carbon having sp3 bonding without containing a resin, which is provided on the surface of the carbon containing area on the side which is in contact with the member to be slid.

8. The sliding member according to claim 1, that is a cleaning member that slides on the member to be slid and cleans the surface of the member to be slid.

9. A process cartridge, which is freely detachable from an image forming apparatus, comprising a cleaning device including the sliding member according to claim 8.

10. An image forming apparatus comprising:

an image holding member;

a charging device that charges the image holding member;

an electrostatic latent image forming device that forms an electrostatic latent image on a surface of a charged image holding member;

a developing device that develops the electrostatic latent image formed on the surface of the image holding member with a toner to form a toner image;

an intermediate transfer medium to which the toner image formed on the image holding member is transferred;

a primary transfer device that primarily transfers the toner image formed on the image holding member to a surface of the intermediate transfer medium;

a secondary transfer device that secondarily transfers the toner image transferred to the intermediate transfer medium to a recording medium; and a cleaning device that includes the sliding member according to claim 8 and cleans the surface of the intermediate transfer medium after the toner image is transferred by the secondary transfer device.

* * * * *